United States Patent [19]

Reid, Jr. et al.

[11] 4,020,821

[45] May 3, 1977

[54] GAS-FIRED SMOOTH TOP RANGE

[75] Inventors: Edward A. Reid, Jr., Westerville; George W. Myler, Upper Arlington; James E. Payne, Columbus, all of Ohio

[73] Assignee: Columbia Gas System Service Corporation, Wilmington, Del.

[22] Filed: Feb. 18, 1976

[21] Appl. No.: 659,010

Related U.S. Application Data

[63] Continuation-in-part of Ser. No. 557,032, March 20, 1975.

[52] U.S. Cl. ..... 126/39 E; 431/192; 431/286

[51] Int. Cl.[2] ..... F24C 3/10

[58] Field of Search ..... 431/191, 192, 193, 194, 431/286, 349; 126/39 E

[56] References Cited

UNITED STATES PATENTS

| | | | |
|---|---|---|---|
| 2,728,384 | 12/1955 | Anderson | 431/286 X |
| 2,737,233 | 3/1956 | Mueller | 431/286 X |
| 2,801,686 | 8/1957 | Flynn | 431/286 |
| 2,834,408 | 5/1958 | Reinhart et al. | 431/193 X |
| 3,399,024 | 8/1968 | Branson | 431/286 |
| 3,545,908 | 12/1970 | Lohman | 431/286 |
| 3,926,172 | 12/1975 | Saponara | 126/39 E |

*Primary Examiner*—Edward G. Favors
*Attorney, Agent, or Firm*—Harold L. Stults

[57] ABSTRACT

A gas cooking range of the smooth top type has four burners positioned under a single plate of heat-resistant glass/ceramic material; and a single igniter and safety control assembly is centrally positioned between the burners. The supply of gas to each of the burners flows through an ignition chamber where it is ignited, and it then flows through a combustion tube to a combustion chamber, where combustion is completed. Some air is mixed with the gas at the fuel supply control valve, and additional air is supplied through the ignition chamber. The burning gas mixture then flows through the combustion tube to the combustion chamber at the entrance of which an additional quantity of air is added to provide the remainder of air necessary for complete combustion. Air is drawn into the system, and the products of combustion are exhausted by a blower positioned at the lower rear of the range so that a negative pressure condition is maintained along the entire path of flow of the fuel gas from the control valve and through the combustion chamber.

14 Claims, 16 Drawing Figures

Fig. 1
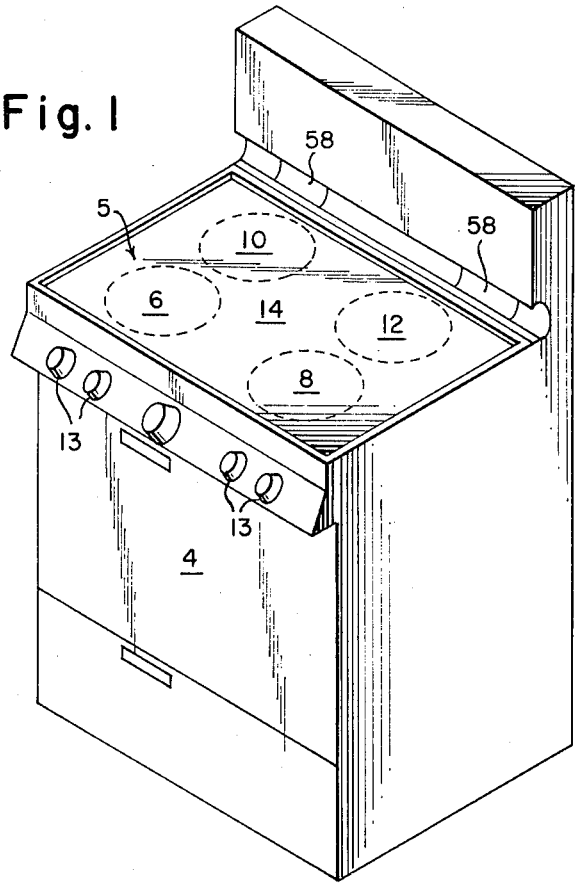
Fig. 6
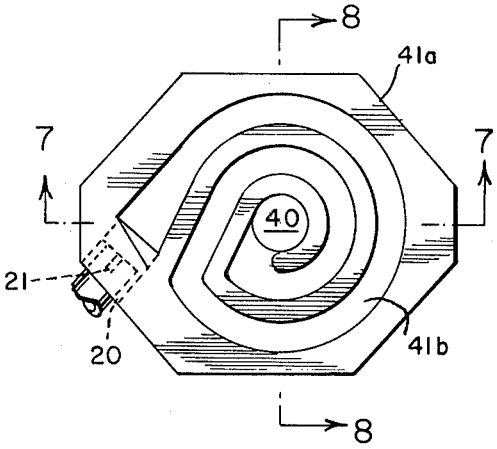
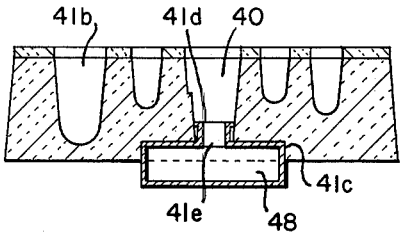
Fig. 7
Fig. 2
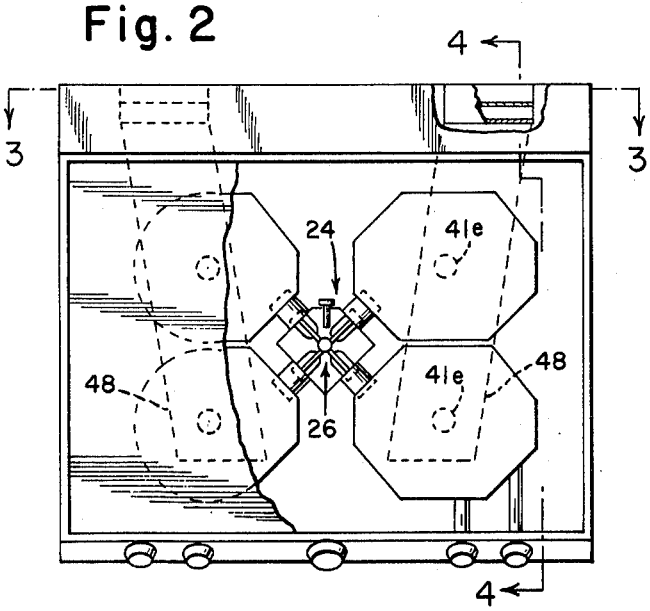
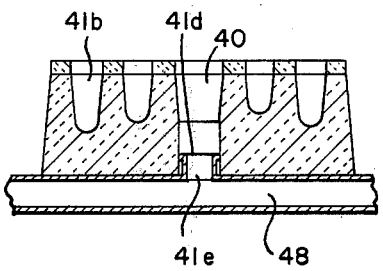
Fig. 8

Fig. 3
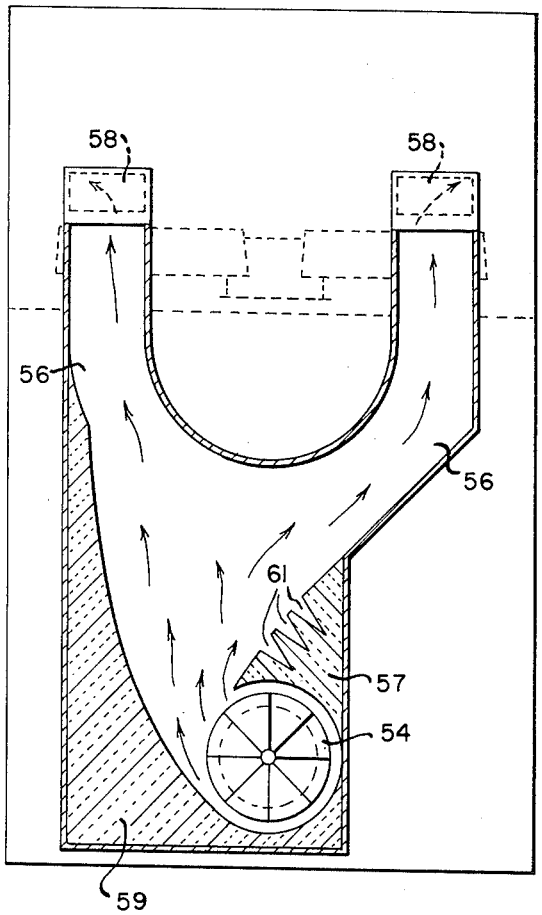
Fig. 4
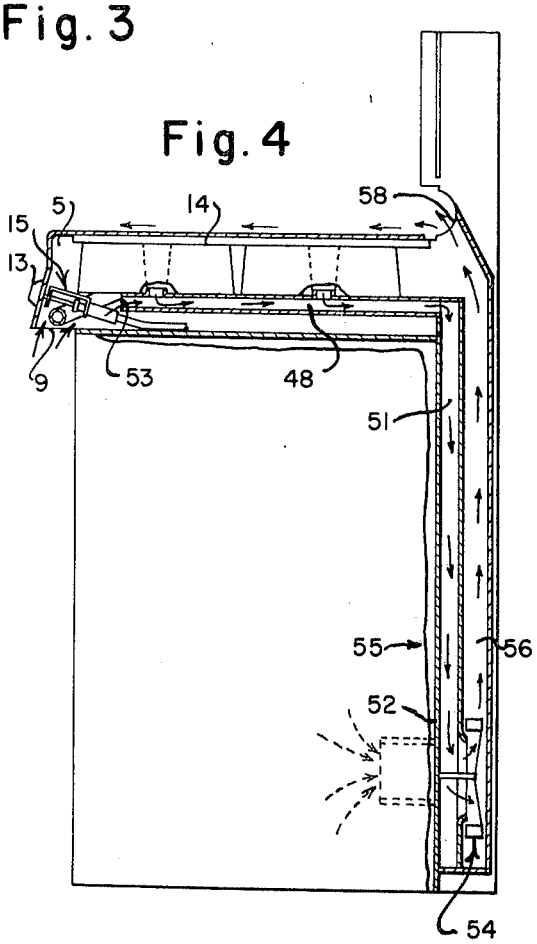
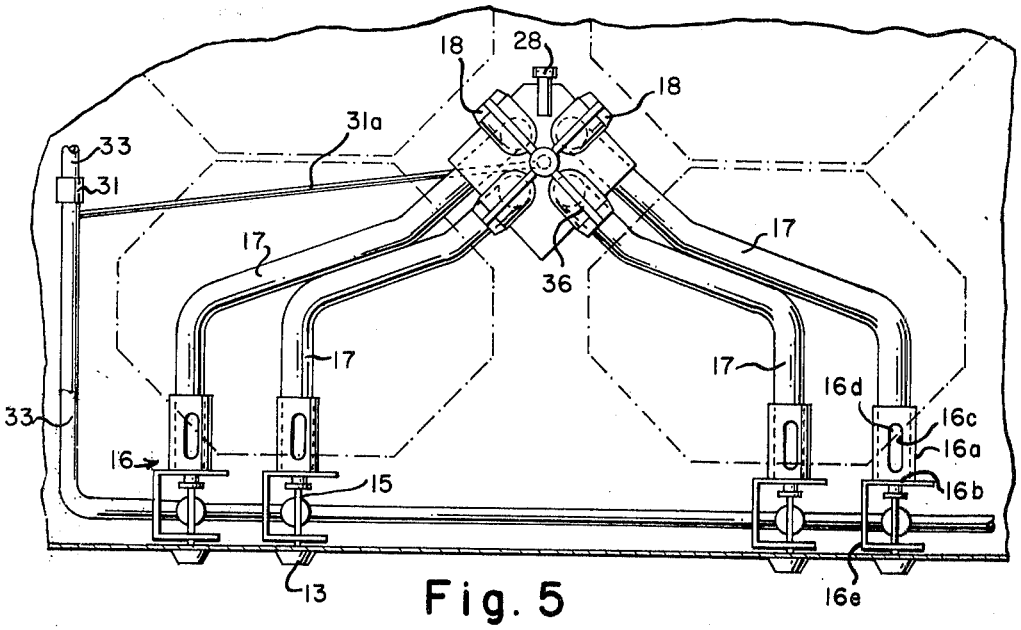
Fig. 5

Fig. 14
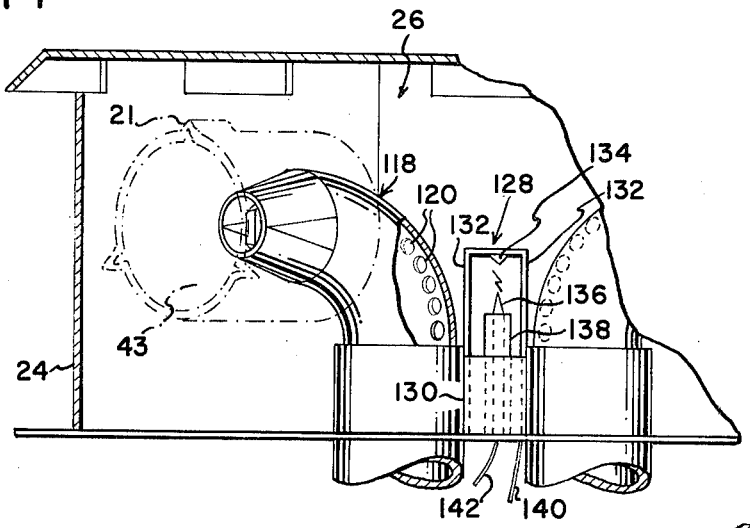
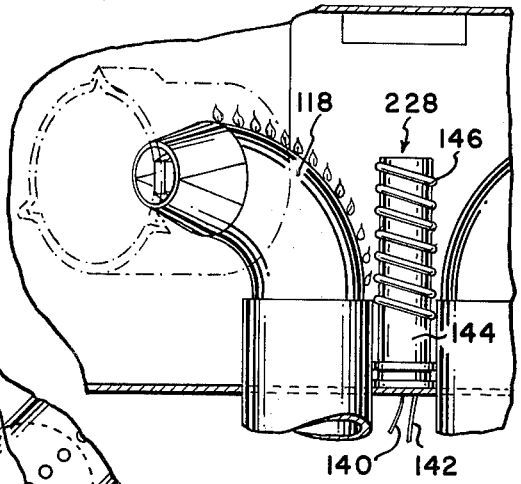
Fig. 16
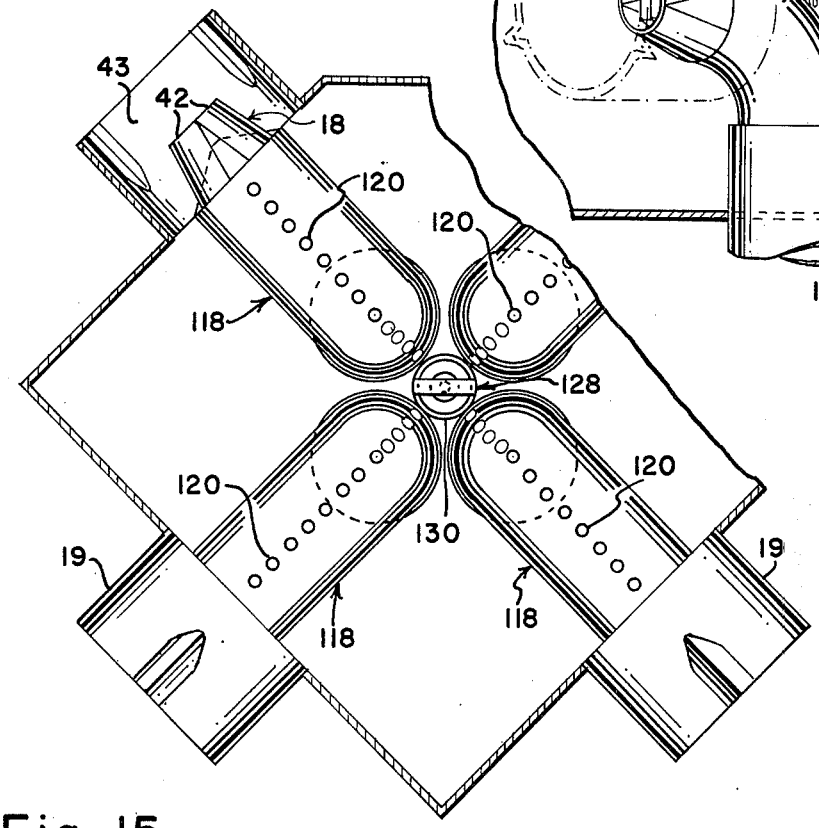
Fig. 15

GAS-FIRED SMOOTH TOP RANGE

This application is a continuation-in-part of application Ser. No. 557,032, filed Mar. 20, 1975.

This invention relates to cooking ranges and fuel gas burner systems. More particularly, it relates to kitchen gas ranges of the smooth top type, and to systems for supplying fuel gas and air to gas burners. An object of this invention is to provide improved operation and control for gas cooking ranges. Another object is to provide improved fuel gas and air supply systems for gas burners. A further object is to provide for the above with structures which are free of the limitations which have been present in the prior art. A still further object is to provide for the above with constructions which are simple and sturdy, efficient, dependable and safe in operation, inexpensive to manufacture, and which require minimum service and repair. These and other objects will be in part obvious and in part pointed out below.

Residential smooth top gas ranges have been the object of considerable developmental work. However, the past efforts have not produced a commercially acceptable construction, primarily because of the high production costs associated with solving the technically complex problems involved in combustion and ignition and automatic safety control systems, and in providing more efficient systems. The burners in ranges of this type must burn in an enclosed combustion chamber beneath a plate of heat-resistant glass, and the design and construction must be such as to insure proper combustion and the desired cooking performance. Also, because the burners are positioned beneath the plate of glass/ceramic, they must be treated as "concealed burners", and must have completely reliable systems for providing ignition and for proving that ignition has taken place, and to insure that the gas supply is turned off automatically if there is any malfunctioning. In accordance with the present invention a thoroughly practical and operable smooth top gas range is provided which meets the highest standards of safety and performance, and which is acceptable from a standpoint of initial cost.

The illustrative embodiment of the present invention is a smooth top gas range of the "powered type" in that a negative pressure or subatmospheric condition is maintained throughout the entire zone occupied by the burners and the fuel gas and air supply system. A single low-pressure blower provides the air required for combustion of the fuel gas, and for drawing the fuel gas and air into the burner combustion chambers and then exhausting and diluting the products of combustion to a reduced temperature so that they can be safely discharged to the atmosphere. The blower also provides the desired air circulation for cooling the entire range-top assembly surrounding the zones of combustion during operation and for cooling down the burner combustion chambers and heat-resistant glass after the range has been turned off.

In the Drawings:

FIG. 1 is a perspective view of a smooth top gas range which constitutes one embodiment of the invention;

FIG. 2 is a top plan view of the range of FIG. 1;

Figure 9:
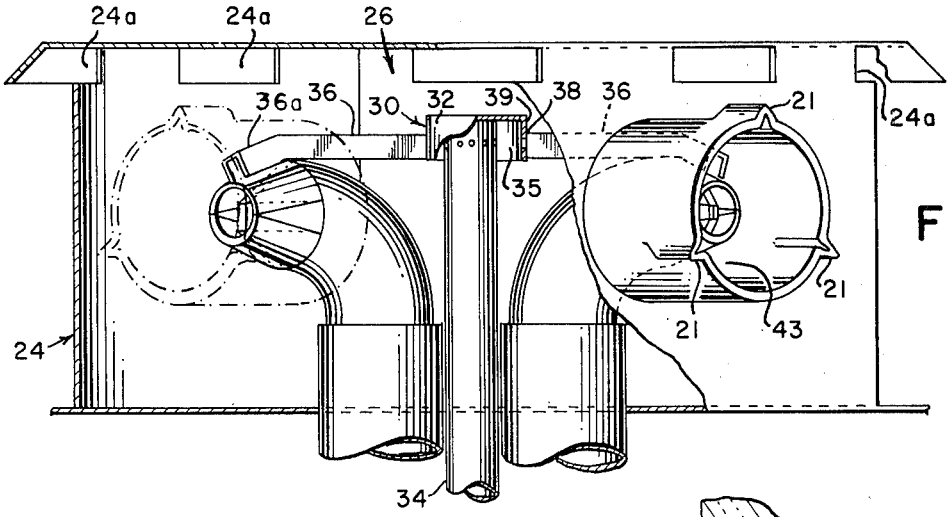
Figure 10:
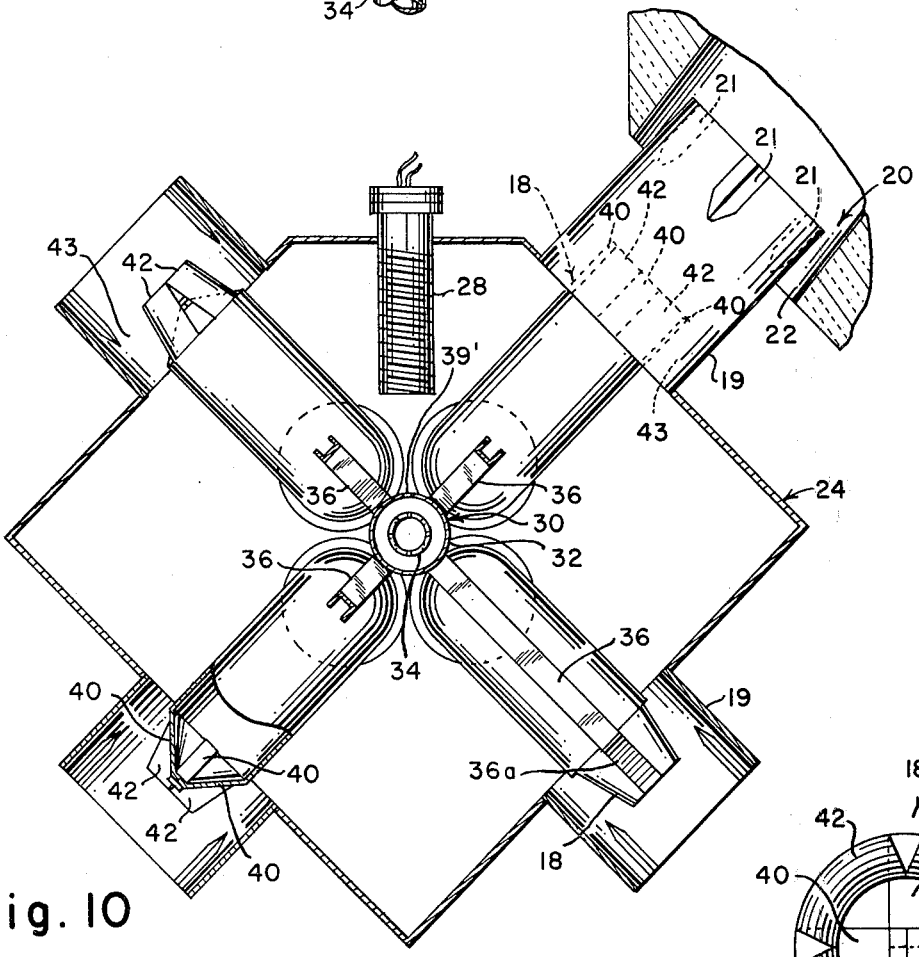
Figure 11:
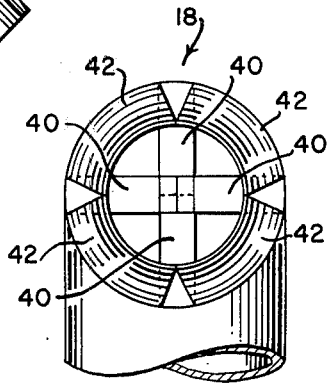
Figure 12:
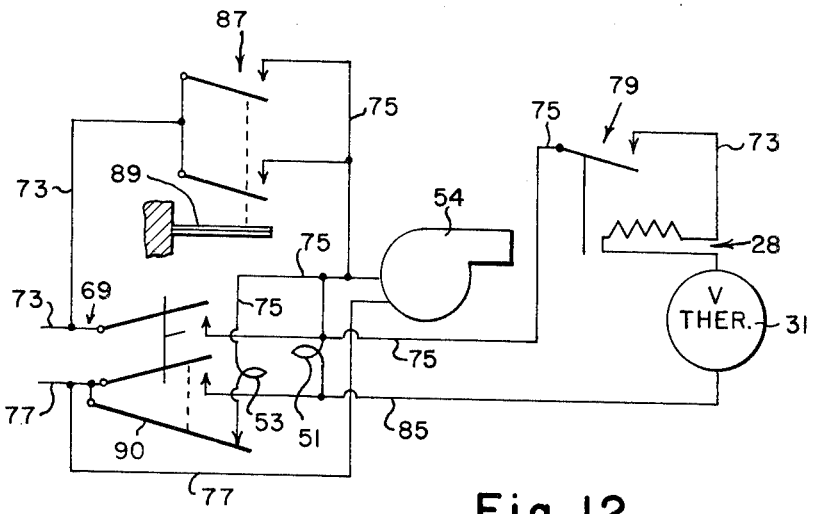
Figure 13:
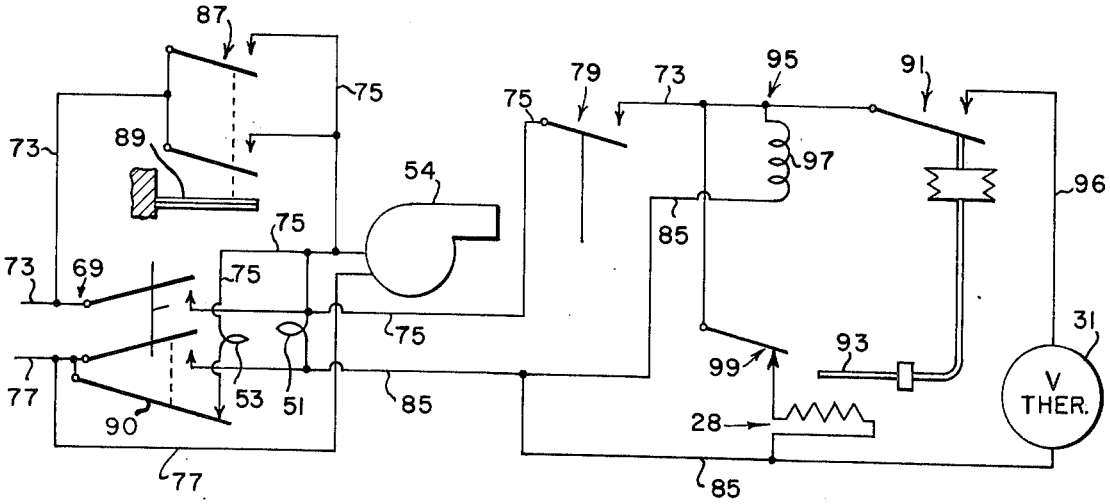

FIGS. 3 and 4 are vertical sections on the lines 3—3, 4—4 respectively on FIGS. 2 and 3;

FIG. 5 is a somewhat schematic view of the fuel gas, and air supply system for the burners in the range of FIG. 1;

FIG. 6 is an enlarged top plan view (with parts broken away) of one of the burner combustion chambers of the range of FIG. 1;

FIGS. 7 and 8 are sectional views respectively on the lines 7—7 and 8—8 of FIG. 6;

FIG. 9 is an enlarged perspective view (with parts broken away) of the ignition system shown at the center of FIG. 2;

FIG. 10 is a top plan view of the ignition system of FIG. 9;

FIG. 11 is a greatly enlarged perspective view of the burner tips of FIG. 9;

FIGS. 12 and 13 are schematic representatives of the control systems for the illustrative embodiment;

FIGS. 14 and 15 are similar to FIGS. 9 and 10, but show another ignition system; and FIG. 16 is a view similar to FIG. 14 but showing another ignition system.

Referring to FIG. 1 of the drawings, a smooth top gas range has an oven 4, and above the oven there is a double inclusion burner enclosure 5 within which there are four cooking burners which heat areas 6, 8, 10 and 12. The burners have identical fuel gas and air supply and ignition systems. Individually operable fuel supply valves control the flow of gas to the respective burners and are controlled by knobs 13 for valves 15 (FIG. 4). A plate of heat-resistant glass/ceramic 14 covers the entire top of the range and provides the top wall for each of the burner combustion chambers and also for the space between and around the combustion chambers. The burner system is of the indirect infrared type, and plate 14 transmits infrared radiation. When one of the burners is ignited, a load, such as a pot or pan, resting above it on the plate 14 is heated by both conduction and radiation through the glass-ceramic plate.

Referring to FIG. 5, the fuel gas and air supply for each of the burners includes: a gas valve 15 which supplies a controlled stream of gas for its burner; a shutter air valve 16; a mixing tube 17 having a burner tip 18 through which the fuel gas and air mixture is discharged, and on which the flame for that burner stabilizes; and a combustion tube 19 (FIG. 10) which receives the ignited stream of fuel gas and air from its burner tip and discharges the stream into the combustion chamber of the respective burners. In the present discussion of the mode of operation we have omitted reference to certain of the safety control features which will be discussed later.

A negative pressure condition exists throughout the flow path for the fuel gas and the air mixed with it, and that acts to draw the air into the fuel gas stream. This negative pressure condition is established by a blower 54 at the rear of the range which as described more fully hereinafter, acts to draw air into the enclosure 5 through openings 9 on the lower side of the range's front panel.

Fuel for the burners is provided through a supply line or manifold 33 upon operation of a thermally actuated valve 31. The jet of fuel produced from valve 15 is projected into its associated mixing tube 17 and simultaneously a stream of air is drawn through the shutter valve 16 into the mixing tube 17 around the jet of fuel gas to form a gas-air mixture. Air shutter valve 16 is gradually opened to supply an increasing amount of air to the mixing tube. The quantity of air supplied to the mixing tube is not sufficient to support combustion of the gas mixture so that there is no danger of flash-back into the mixing tube. As the mixture is discharged from the burner tip 18, additional air enters the end of the combustion tube in the annular space 43 formed around the burner tip by the surrounding end of the combustion tube 19. The air-gas mixture is ignited at this location by a pilot arrangement described below. While there is then a substantially increased amount of air in the stream and the moving gas stream is a flame, there is still insufficient air to provide complete combustion of the fuel gas. Accordingly, the discharge end of the combustion tube 19 is positioned in the inlet port 20 of the combustion chamber formed in the burner block, as described hereinafter, to define an annular space 22 around the discharge end of the combustion tube through which the additional amount of air enters which is necessary for complete combustion of the fuel gas.

Shutter valve 16 (see FIG. 5) is formed by a sleeve 16*a* having an annular end wall 16*b* through which the gas outlet from valve 15 projects into mixing tube 17. Sleeve 16*a* fits snuggly around the mixing tube, and both the sleeve and the tube have oval openings 16*c*, 16*d* respectively which form the operative valve in that they supply the maximum desired amount of air to the mixing tube when they are in alignment (as seen in FIG. 5) and the amount of air is reduced as the sleeve is rotated from that position. Sleeve 16*a* is attached to the stem of valve 15 by a bracket assembly 16*e*. When the gas valve 15 is fully opened, the air inlet openings 16*c*, 16*d* in the sleeve and tube are in alignment to admit the maximum amount of air; when the valve 15 is moved toward its closed position, the sleeve opening 16*c* is moved completely out of alignment with the tube opening 16*d*, thus closing the shutter valve. However, some air leaks into the mixing tube even when the shutter valve is closed during the initial turning movement of valve 15 from its fully closed position.

Centrally positioned between the burners (see FIGS. 2, 9 and 10) beneath plate 14 is an ignition chamber 24 for an ignition system 26. The system includes a known-type silicon-carbide electric resistance igniter 28, and a pilot and ignition tube assembly 30.

The ignition tube assembly is formed by four horizontal flame tubes 36 integral with a central hub 32. The latter is securely mounted upon the top end of a pilot tube 34 which is the gas line through which gas is supplied to provide a pilot flame for each of the burners. Gas for the pilot tube 34 is supplied from manifold 33 downstream of the valve 31 through the conduit 31*a*.

The hub 32 has a slightly larger diameter than the pilot tube 34, in order to provide an annular space 35 around the upper end of the tube. Flame tube 36 are U-shaped in cross-section, and open along their bottom surface. The tubes have their inner ends 38 positioned and secured in alignment with openings in the outer wall 39 of hub 32 to allow each tube to carry a flame from hub 32 outwardly to its burner tip.

There are eight ports in the upper end of the pilot tube. Four of these ports are aligned axially respectively with the inner ends 38 of the four flame tubes 36, and project a stream of gas along these tubes toward the individual burner tips. One of the ports is aligned axially with an opening 39' in the vertical rim 39 of the hub 32 and projects a stream of gas beyond the hub to the electric resistance igniter 28 which lights the pilot flames. The three additional ports are located around the circumference of the pilot tube, and are directed against the vertical rim 39 of the pilot hub. The gas from these ports impacts against the rim of the hub and spreads within the annular space 35 in the hub. In this manner the jet of gas from opening 39' is ignited and, in turn, ignites the gas from the other openings in the pilot tube, thereby producing a flame throughout annular space 35 to assure that all of the ports on the pilot are lighted from the single electric resistance igniter 28. It is noted that hub 32 and pilot tube 34 are preferably located with respect to each other by cooperating keying elements (not shown) to insure proper alignment of the various ports with the igniter and the flame tubes.

Each of the flame tubes has a downwardly slanting end portion 36*a* which extends along and terminates at the top of the burner tip 18 for its burner. Hence, when the pilot burner is operating, there is a flame at the end of each of the burner tubes which is directly over its burner tip and ignites a fuel gas and air mixture which is discharged from that tip if its valve has been operated.

Each of the burner tips 18 may be formed integral with the end of its mixing tube 17 by slitting the tube to form strips, and then bending the strips radially inwardly. For illustrative purposes only, the original form of the end of the tube is shown in broken lines at the upper right hand burner tip 18 in FIG. 10, wherein four of the eight slits are shown in broken lines. Those slits form narrow tabs or strips 40 and four wide tabs or strips 42. Each of the narrow strips 40 is then bowed inwardly to a somewhat arcuate form to a position where their ends meet to form an open dome-like construction having a square central opening 40'. (See FIG. 11). The wide strips 42 are then bowed inwardly to form an open end. The fuel gas and air mixture is discharged through the burner tip with a great deal of turbulence and stabilized uniform flow. The burner tip is located within the combustion tube, and the gas stream from the burner tip is projected axially within the combustion tube 19. The gas stream is ignited with the additional air which is drawn into the annular space 43 between the tip 18 and tube 19 because of the surrounding negative pressure condition. In this connection it is noted the ignition chamber 24 has openings 24*a* formed therein through which air can enter, under the influence of blower 54 as described hereinafter, so as to enter the annular space 43.

The combustion chamber for each of the burners is formed from an integral block 41*a* of an insulating fibrous refractory ceramic material with glass/ceramic plate 14 forming the top wall. The combustion chamber is a spiral cavity or channel 41*b*, which winds from an entrance opening 20 to a central exhaust opening 40. The width and depth of the channel are enlarged at the entrance end to permit the entry of the additional air required for combustion of the gas-air mixture through the annular space 22 (see FIG. 10) between the combustion tube 19 and the inlet end of cavity 41*b* and to promote proper mixing of that air with the burning fuel gas mixture from combustion tube 19. The annular space 22 is maintained uniformally about tube 19 by means of spacing projections 21, formed on the tube which serve to hold the periphery of the tube away from contact with channel 41*b*. From the entrance section, the depth of the combustion chamber passage decreases progressively toward the centrally located exhaust opening 40. The decreasing cross-sectional area of the combustion chamber passageway compensates for the decreasing volume of the combustion products as heat is transferred from them and their temperature decreases, thus maintaining a relatively constant velocity of the combustion products to optimize heat transfer. The long, narrow passage created by this combustion chamber design increases the residence time of the combustion products in the combustion chamber, assures that the entire surface of the glass which is to be heated is exposed to the products of combustion, and thus improves the uniformity of temperature distribution on the heated surface.

The surfaces of the combustion passage may be roughened to introduce turbulence into the flowing gas stream and increases the surface area heated by the combustion products to increase total amount of infrared radiation generated in the combustion chamber. The surfaces may also be coated with materials such as silicon carbide to improve the radiant emittance of the combustion chamber surfaces. The quantity of radiation generated by the surfaces of the combustion chamber passage is significant since the glass/ceramic which forms the smooth top surface of the range is infrared transparent, and therefore, infrared energy can be delivered efficently through this glass/ceramic surface to the cooking vessel to be heated. Also, by increasing the quantity of radiation which is delivered through the glass/ceramic to the cooking vessel, the quantity of heat which must be delivered to the glass/ceramic by conduction is decreased, thus decreasing the working temperature of the glass/ceramic. This combination of radiation and convection heat transfer also makes it possible to deliver more heat through the glass/ceramic per square inch of the surface area without exceeding the maximum working temperature of the glass-/ceramic than would be possible if all the heat were transferred by conduction.

The insulating refractory fiber construction of the combustion chamber reduces the amount of heat required to bring the heated surfaces of the combustion chamber up to their optimum working temperature and also reduces the heat loss from the combustion chamber into the surrounding area of the range top, thus making it possible for the rest of the range top to remain cool while one or more burners are in operation. Plate 14 fits tightly against the top flat surface of the ceramic blocks; however a soft crushable interface or gasket 39*a* or the like may be positioned therebetween on the top surface of the block to form a gas seal. In any case the negative pressure condition prevents any tendency for the products of combustion to migrate outwardly from the side edges of the burners.

The products of combustion are exhausted from the burners toward the back of the range through two flue ducts 48 in the burner enclosure 5, one extending rearwardly from beneath burner 6 and thence beneath burner 10, and the other extending rearwardly from beneath burner 8 and thence beneath burner 12. Each of these ducts has a controlled air inlet opening 53 in the upper half of its front edge through which air is drawn into the duct to control the negative pressure in the combustion systems, and also to cool the products of combustion before they reach the blower inlet at the rear of the range. Referring to FIGS. 3 and 4, at the back of the range there is an enclosure 55 which extends the width and height of the range. At the rear of the burner enclosure, flue ducts 48 are connected respectively to the tops of a pair of vertical flue ducts 51 which are within enclosure 55 and extend downwardly and join a lower duct 52 to form a Y-duct assembly. At the bottom of duct 52, there is a blower 54 which draws the products of combustion from duct 52 and which directs the resulting mixture of gases upwardly through a discharge duct 56. In discharge duct 56 and exhaust gases are expanded by a factor of two to reduce their velocity and the resulting velocity generated noise. Two shaped pieces of fiberglass insulation 57 and 59 control the rate of expansion of the exhaust gases in duct 56, and minimize turbulence and the associated pressure loss. The fiberglass also absorbs a substantial portion of the noise generated by the blades of the blower wheel. Several deep, narrow V-shaped notches 61 are cut into insulation block 57 to improve the sound absorption characteristics of the system. This arrangement reduces the noise level approximately 50 percent. The overall shape of the fiberglass blocks also balances the flow of the exhaust products to the left-hand and right-hand sides of the exhaust system. A small amount of additional air is drawn into duct 52 through the blower motor to keep the motor cool, and provide additional dilution of these products of combustion. Duct 56 terminates behind a vertically disposed grill 58 which extends upwardly along the back edge of the smooth top range. Hence, the products of combustion are diluted and cooled by the addition of the ambient air which is drawn into blower 54, through the duct system from opening 53, and the resulting stream of gases is discharged upwardly at the rear of the range top at a temperature of the order of not more than 250° F. Moreover, the expansion of the gases and the remote positioning of the blower reduce the noise perceived by the user.

As shown in FIG. 7, each of the combustion or burner blocks 41*a* has an inverted channel 41*c* into which its duct 48 is positioned so as to support the block and locate it in both horizontal and vertical positions on the duct in the frame of the stove. In addition, the ducts 48 have annular flanges 41*d* formed thereon which surround openings 41*e* in the ducts and extend into the exhaust openings 40 of the respective burner blocks. Hence, the blocks are located and held fixed in predetermined longitudinal positions along their respective ducts.

Referring to FIG. 12, which is a schematic representation of the control system, the ignition and gas supply system and blower 54 are activated by actuating the "UNIT ON" switch 69 located on the background of the range. Switch 69 is connected to a pair of power lines 73 and 77 and, has a normally-open switch unit which connects the high side line 73 through a line 75 to the electric motor of the blower, and the other side of that motor is connected directly to the neutral line 77. When the air flow from the blower has reached design operating conditions, the air flow closes a sail switch 79 which is connected to line 75, and the closing of which then supplies power to the circuit which controls igniter 28 and the fuel gas supply. The main gas supply manifold 33 for the range top receives gas from a thermally actuated bimetal valve 31 which is wired in series with igniter 28. The other electrical terminal of valve 31 is connected through a line 85 which in turn is connected to the neutral line 77 when the normally open unit of switch 69 is closed. Igniter 28 and valve 31 are of known construction.

The electrical resistance of the igniter is relatively high when it is cold and drops to a low value when it reaches the temperature at which it will ignite the gas, and valve 31 opens only when the resistance of the igniter drops, thus increasing the voltage across the valve. Therefore, no gas is available in the range top manifold 33 until the "UNIT ON" switch 69 has been set to the "on" position, the air flow from the blower has reached normal level, and the igniter has reached the necessary ignition temperature. When the gas valve opens, the gas flows to the main manifold and to the pilot tube (through line 31*a*, FIG. 5) and it will also flow to the various burners through their respective valves 15. The gas flowing from the pilot tube is ignited by the electric resistance igniter to produce the pilot flame to ignite the individual burners.

As mentioned, after any one of the burners has been ignited, blower 54 is operated as long as the burner is on and continues to operate after the burner is shut off until the burner temperature has been reduced to a predetermined level by cool air flowing through the unit. That is accomplished by thermally actuated switches 87 connected at one side to line 73 and at the other side to line 75. Switches 87 are normally open, and they are closed by the operation of bimetalic thermostat elements 89. A signal light 51 is connected between lines 75 and 85, and indicates that the "UNIT-ON" switch is actuated. A signal light 53 is connected between line 75 and a normally closed switch unit. 90 which is connected to line 77. Light 53 indicates that the blower is still operating, even though switch 69 has been turned to the "UNIT-OFF" position with its normally open switches open. It is noted that this system is essentially self proving in that the igniter must ignite the pilots for the burners to operate. If the igniter should fail the valve will close and the blower will remove and dilute any gas entering the system in the intervening period. Thus, the system is entirely safe.

The control system of FIG. 13 is identical with that of FIG. 12, except for the arrangements for controlling the energization of igniter 28 and thermal valve 31. In the system of FIG. 13, line 73 is connected to a relay 95 which has a heated bimetal element 97 connected between lines 73 and 85. The relay has its normally-closed switch 99 connected between line 73 to the igniter, the other side of which is connected to line 85. However, relay 95 is a time delay relay so that its switch opens only after there has been sufficient time for the igniter to ignite the gas. Line 73 is also connected to a normally-open thermostatic switch 91 which has a thermal bulb 93 positioned adjacent igniter 28 and also in the zone where it is heated by the pilot flame. Switch 91 is connected at its other side through a line 96 to valve 31, the other side of which is connected to line 85. Hence, when the igniter reaches the gas igniting temperature, bulb 93 is heated, switch 91 is closed, and valve 31 is opened to supply gas to the manifold. The flame is then ignited, after which the time delay relay switch 99 opens to extinguish the igniter. Valve 31 then remains open as long as the pilot light continues to burn, and power is supplied to the valve through lines 75 and 95. However, if the pilot is extinguished, switch 91 is opened, thus closing valve 31.

It should be noted that in systems of FIG. 12 and 13 blower 54 operates continuously whenever switch 69 is closed, and the first step preparatory to using the range is to close the switch and start the blower. With normal functioning the igniter is turned on and heated up, and then valve 31 is opened so as to supply gas to the manifold and thence through the pilot tube so that the pilot flame is ignited. Any of the burners can then be ignited by turning the respective control knob at the front of the range. With the control system of FIG. 13, an additional safety feature is provided in that the igniter is turned off after a predetermined period of time, and that results in the opening of switch 91 and closes valve 31 so as to shut off the gas flowing to the manifold if the pilot flame has not ignited.

During operation, a very rich mixture is produced by the controlled amount of air which is added to the stream of fuel gas at valve 15. That amount of air is increased as the gas valve opens, and is from 25 to 30 percent of the amount required for complete combustion of the fuel gas, and is not sufficient to support combustion. An additional amount of air is added at the ignition zone, and the remainder of the air necessary for complete combustion is added at the inlet to the combustion chamber. That control of the flow results from the controlled air inlet openings at shutter valve 16, at the ignition zone, and at the inlet 22 to the combustion chamber. Also involved is the level of the negative or sub-atmospheric pressure which is maintained at the discharge zone from the burner, which is constant for all heat levels.

During low heat operation, a relatively small amount of fuel gas is mixed with a corresponding small amount of air at the valve, but the somewhat unchanged greater quantities are added to the stream at the ignition zone and at the commbustion zone. That means that during low heat conditions there is high dilution of the products of combustion with the relatively large quantity of air. That gives the desired lower temperature in the combustion chamber. At high heat conditions there is a greater amount of air added at the valve and substantially the same amount is added at the ignition zone and the combustion zone. That causes more combustion between the ignition zone and the combustion chamber so as to heat up the gas stream which enters the combustion chamber. That is, the ignited gases passing into the combustion chamber are at a high temperature during high heat operation so that the additional air which is added at the combustion chamber does not cool the resultant mixture as much as during low heat operation, and never below the minimum acceptable temperature. The large quantity of air which is mixed with the products of combustion passing to the blower is effective at all times to reduce the temperature of the mixture to an acceptable level.

In the embodiment of FIGS. 14 and 15, the construction and operation are identical with the embodiment of FIGS. 1 to 13, inclusive, except that a simplified ignition system is utilized. There is no separate pilot tube 34 and no pilot light 30, as in FIGS. 1 to 13; and, resistance igniter 28 of FIGS. 1 to 13 is replaced by an electric-spark igniter 128. Igniter 128 is positioned centrally of the burner tips 118 in the position of pilot tube 30 in FIGS. 9 and 10. That is, spark igniter 128 has its axis concentric with the vertical axis of ignition chamber 24, so that burner tips 118 extend radially from the igniter. Igniter 128 is of known construction, and when energized produces a series of ignition sparks. Igniter 128 has an outer sheet metal shell 130 with a pair of parallel vertical arms 132 between the tops of which there is an integral horizontal strip upon which the top electrode 134 is mounted. The lower electrode 136 is supported by its stem in the center of a ceramic tube 138. Electrical connections are provided to the upper electrode through the shell from a wire 140, and to electrode 136 by a wire 142. Hence, the electrical current flows through the shell to the upper electrode and to the lower electrode through its stem in the center of the ceramic tube, and a spark is produced between the electrodes as indicated.

Each of burner tips 118 has a row of perforations or jet holes 120 extending along its crest 122 from its gas discharge port horizontally toward the axis of igniter 128 and thence downwardly along the vertical surface of the burner tip adjacent the igniter. Hence, when any burner is to be operated, its knob 13 is turned to open its valve 15 and igniter 128 is energized. As gas flows to its burner tip, a small jet of the gas flows from each of jet holes 120. The jets adjacent the spark igniter are ignited immediately, and the flame travels from one jet to the next up and across the ridge of the burner tip to the discharge port, and that ignites the burner. The spark igniter operates in the known manner and maintains the burner ignited whenever gas is supplied to it. Igniter 128 has a known type of spark ignition circuit which is adapted to receive electrical current from a source identical with igniter 28 of FIGS. 1 to 12. Accordingly, the electrical circuit diagram is the embodiment of FIGS. 14 and 15 for that shown in FIG. 12, and the spark ignition circuit of igniter 128 is connected directly across lines 73 and 85 of FIG. 12.

The embodiment of FIG. 16 is identical with that of FIGS. 14 and 15, except that a resistance type igniter 228 replaces igniter 128. Igniter 228 is of known construction and is formed by a ceramic cylinder 144 around which there is a spiral resistance wire 146. The ends of the resistance wire are connected to wires 140 and 142 respectively. Hence, igniter 228 is heated continuously when the range is being operated and the jets of gas from jet holes 120 are ignited and carry the flame from the igniter to each burner tip in the manner discussed above.

It is understood that the construction and operation can be modified in accordance with the invention within the scope of the claims.

What is claimed is:

1. Ignition means comprising, a pilot tube for delivering gas to an ignition zone, said pilot tube having at least one ignition port for directing a stream of gas outward of said tube; a source of ignition positioned adjacent said port; said pilot tube also having at least one main port formed therein for directing a stream of gas toward a burner to be ignited; flame tube means for guiding said stream of gas to the burner to be ignited; said pilot tube also having at least one pilot port formed therein between said ignition and main ports for assuring that the main port is ignited when the ignition port is ignited, and means for fixing the relationship of the flame tube to the burners to be ignited.

2. Ignition means as defined in claim 1 including means for proving that the ignition port flame is ignited.

3. Apparatus as defined in claim 2 in which said ignition proving means comprises an electric resistance igniter.

4. Apparatus as defined in claim 3 wherein said flame tube means comprises a plurality of tubes projecting radially outward from a central hub mounted on the pilot tube.

5. Apparatus as defined in claim 4 wherein said pilot tube has a plurality of main ports aligned axially with the flame tubes.

6. Apparatus as defined in claim 5 wherein said pilot port projects a stream of gas against the hub, to assure ignition of the main ports.

7. Apparatus as defined in claim 2 including a flame switch for detecting ignition of the pilot flame.

8. In a gas range having a plurality of burners each of which has a conduit which forms a passageway for the gas passing to it which extends radially outwardly from an axis to a burner tip; and means to supply a separate stream of gas to each of said burner with the streams passing to the respective burner tips through said conduits along paths which extend radially from said axis, and a single source of ignition adjacent said axis, the construction including flame-transmitting means which supplies gas along the top of each of said conduits from said source of ignition to the respective burner tips.

9. Apparatus as described in claim 8 wherein said flame-transmitting means comprises a tube and means to project a stream of gas radially outwardly with respect to said axis through said tube.

10. Apparatus as described in claim 9 wherein said flame-transmitting means comprises a row of closely spaced small openings in each of said conduits through which gas passes from the conduit when gas is passing therethrough to its burner tip, whereby a flame adjacent said axis ignites the gas passing from openings and migrates to the burner tip of each burner when gas is supplied thereto.

11. Apparatus as described in claim 10 wherein said source of ignition comprises a spark igniter positioned at said axis.

12. Apparatus as described in claim 11 wherein each of said conduits has a downwardly extended portion and each conduit has its row of small openings extending from adjacent said igniter and thence along the top of the conduit.

13. In a gas range having a plurality of burners, the combination of, a common igniter assembly, means to supply gas for each of said burners to said igniter assembly, said igniter assembly including a plurality of conduits comprising one conduit for each of said burners, each of said conduits terminating in an integral burner tip, said conduits having longitudinal portions which extend radially from a common axis to the respective burner tips, spark igniter means positioned at said axis, each of said conduits having an extension which presents a wall adjacent said spark igniter means, said conduits having gas outlet openings extending from adjacent said spark igniter means to the burner tip of that conduit whereby, when gas is flowing through one of said conduits, a row of gas is formed along the outer surface of the conduit by gas passing therefrom and is ignited by said igniter means and the flame passes along said row of gas and is transmitted from adjacent said igniter means to the respective burner tip.

14. Apparatus as described in claim 9 wherein said source of ignition comprises a resistance type heater igniter positioned at said axis.

* * * * *